United States Patent [19]

Moy

[11] Patent Number: 4,540,531

[45] Date of Patent: Sep. 10, 1985

[54] VAPOR GENERATOR AND ITS USE IN GENERATING VAPORS IN A PRESSURIZED GAS

[75] Inventor: Timothy Y. Moy, Dublin, Ohio

[73] Assignee: Ashland Oil, Inc., Ashland, Ky.

[21] Appl. No.: 607,248

[22] Filed: May 4, 1984

[51] Int. Cl.[3] ..... B01F 3/04

[52] U.S. Cl. ..... 261/141; 164/16; 261/64 B; 261/65; 261/124; 261/DIG. 65; 427/255.3

[58] Field of Search ..... 261/64 B, 65, 121 R, 261/122, 124, 141, DIG. 65, 142; 164/16, 526; 427/255.2, 255.3

[56] References Cited

U.S. PATENT DOCUMENTS

| | | | |
|---|---|---|---|
| 2,577,389 | 12/1951 | Warriner | 261/124 X |
| 3,528,418 | 9/1970 | Grosholz et al. | 261/DIG. 65 |
| 3,590,902 | 7/1971 | Walker et al. | 164/16 X |
| 3,659,604 | 5/1972 | Melville et al. | 261/DIG. 65 |
| 3,962,381 | 6/1976 | Farrish et al. | 261/141 |
| 4,051,886 | 10/1977 | Ross | 164/16 |
| 4,105,725 | 8/1978 | Ross | 261/122 |
| 4,276,243 | 6/1981 | Partus | 261/121 R X |
| 4,362,204 | 12/1982 | Moore et al. | 164/16 |
| 4,393,013 | 7/1983 | McMenamin | 261/64 B |
| 4,399,081 | 8/1983 | Mabb | 261/121 R |

OTHER PUBLICATIONS

Litz, W. J.; "Design of Gas Distributors"; *Chemical Engineering*, Nov. 13, 1972, pp. 162–166.

*Primary Examiner*—Richard L. Chiesa
*Attorney, Agent, or Firm*—Mueller and Smith

[57] ABSTRACT

Disclosed is a vapor generator for generating a supply of a gas bearing vapors of a compound at a desired concentration. Also disclosed is a method for generating a supply of gas bearing vapors of said compound which process utilizes the vapor generator disclosed herein. The supply of gas bearing vapors can be generated on demand at a desired constant delivery pressure. The generator comprises a gas line for conveying pressurized gas from a source thereof through first pressure regulating means to a vessel; said vessel for retaining a reservoir of said compound in its liquid phase and having headspace thereabove, said vessel being insulated and having heating means to maintain said liquid and said headspace at a desired temperature. The gas line extends into the vessel to a position within the reservoir of liquid and there is terminated with gas distributor means. The vessel is provided with a product vaporous outlet from the headspace from which a gas outlet line connects to a second pressure regulator means. The first pressure regulator means independently controls the pressure in the vessel while the second pressure regulator means independently controls the delivery pressure of the gas bearing said vapors. The concentration of vapors in the supply of outlet gas is determined by the vessel pressure and vessel temperature. Advantageously, the generator may be portable and may be used to generate vaporous amine carried by air or an inert gas.

10 Claims, 10 Drawing Figures

VAPOR GENERATOR AND ITS USE IN GENERATING VAPORS IN A PRESSURIZED GAS

BACKGROUND OF THE INVENTION

The present invention relates to a method and apparatus for generating a supply of a liquid in vaporous state borne by carrier gas.

In making foundry sand cores by the cold box method, a foundry mix of sand and a binder is prepared and shaped. The shaped green core then is gased with a vaporous amine which is carried by air or an inert carrier gas under pressure. The vaporous amine curing agent cures the binder which can be phenolic or other polyol resin in admixture with a multi-isocyanate cross-linking agent. Vaporous tertiary amine catalysts also are required for curing surface coating compositions of a polyol and multi-isocyanate dispersed in a solvent therefor. Such vapor permeation curing technology traditionally has been practiced by containing the amine vapors within a curing chamber through which is passed a coated substrate. A new and alternative approach to the curing chamber involves the concurrent generation of an atomizate of the coating composition and a carrier gas bearing a catalytic amount of the vaporous tertiary amine. The thus-generated gas flow and atomizate are mixed and directed onto a substrate for curing. This modified spray procedure requires the generation of a carrier gas flow bearing the catalytic vaporous tertiary amine of precisely-controlled composition and pressure for use with conventional spray equipment. Such vaporous spray coating process is disclosed by Blegen in commonly-assigned application Ser. No. 06/474,156, filed Mar. 10, 1983 now abandoned.

Traditionally, a variety of methods have been proposed in the art for generating a supply of a carrier gas saturated with vapors of a liquid reactive or catalytic material. In the foundry core area, such techniques have included the pump liquid-injector method wherein liquid amine is injected into an air stream under pressure. Another typical apparatus is know as a bubbler and operates by passing an inert carrier gas through a liquid reservoir of the amine, such as shown in U.S. Pat. Nos. 3,590,902; 4,051,886; and 4,105,725. In other technical areas, vapor generators have been used to supply vapors of materials such as $SiCl_4$, and $GeCl_4$, and $POCl_3$, for example. One such system is shown in U.S. Pat. No. 4,276,243. Of course, a discussion of vapor generators would not be complete without reference to humidification generation, such as shown in U.S. Pat. No. 3,962,381.

While a variety of successful vapor generators have been proposed, problems in reliably delivering a specified concentration of vaporous liquid in the carrier gas stream still is lacking in the art. Additionally, traditional vapor generators do not permit the generator vessel to be operated at one pressure while the resulting vaporous gas flow withdrawn therefrom is being delivered at a different pressure. This latter pressure restriction is important in the vaporous spray process noted above.

BROAD STATEMENT OF THE INVENTION

The present invention is directed to a vapor generator for generating a supply of a liquid in vaporous state which vapors are carried by a carrier gas and are at a desired concentration. The flow of the vaporous gas composition is generated on demand at a desired constant delivery pressure, $P_d$. The generator comprises a gas line for conveying pressurized gas at a pressure, $P_s$, from a source thereof through first pressure regulating means to a vessel. Said vessel retains a reservoir of said compound in its liquid phase and has headspace thereabove. The vessel is insulated and has heating means to maintain said liquid and said headspace at a desired temperature. The gas line extends into the vessel to a position within said reservoir of liqud and its terminated with gas distributor means. The vessel additionally is provided with an outlet communicating with the headspace for withdrawing said gas bearing vapors of said compound generated in said vessel. A gas outlet line is connected to said headspace outlet and thence to second pressure regulator means. The first pressure regulator means independently controls the pressure in said vessel headspace, $P_v$. The second pressure regulating means independently controls the delivery pressure, $P_d$, of said gas bearing said vapors. The desired concentration of vapors in said outlet gas flow is determined by said vessel headspace pressure, $P_v$, and the temperature in said vessel, $T_v$.

Another aspect of the present invention is a method for generating a supply of a gas bearing vapors of a compound at a desired concentration, said supply being generated on demand at a desired constant delivery pressure, $P_d$. Said method comprises conveying pressurized gas at a pressure, $P_s$, from a source thereof through first pressure regulating means to a vessel, said vessel retaining a reservoir of said compound in its liquid phase and having headspace thereabove and being insulated; heating said reservoir and said headspace with heating means to maintain said liquid and said headspace at a desired temperature, $T_v$; contacting said gas with said reservoir through said gas line which extends into the vessel to a position within said reservoir of liquid, said contact being through gas distributor means which are disposed about the end of said gas line within said reservoir. Withdrawing said supply of said gas bearing said vapors from a vessel vapors outlet in communication with said headspace and passing said supply through a gas outlet line to second pressure regulating means. The first regulator means independently controls the pressure in the vessel and the second pressure regulator means independently controls the delivery pressure of said supply of gas bearing said vapors. The desired concentration of vapors in said supply of outlet gas is determined by the vessel pressure and the vessel temperature.

Advantages of the present invention include the provision of independent pressure control of the pressure of the generator and the pressure at which the supply of gas bearing vapors is delivered for use. A further advantage is the ability to maintain a constant vaporous compound concentration continuously by adjustment of the generator pressure and temperature. A further advantage is the ability to utilize a wide variety of compounds for generating vapors thereof, particularly various amines. Still another advantage is the ability to manufacture the generator to be totally portable, only electricity being required for providing heat to the vessel. These and other advantages will be readily apparent to those skilled in the art based upon the disclosure contained herein.

Figure 1:
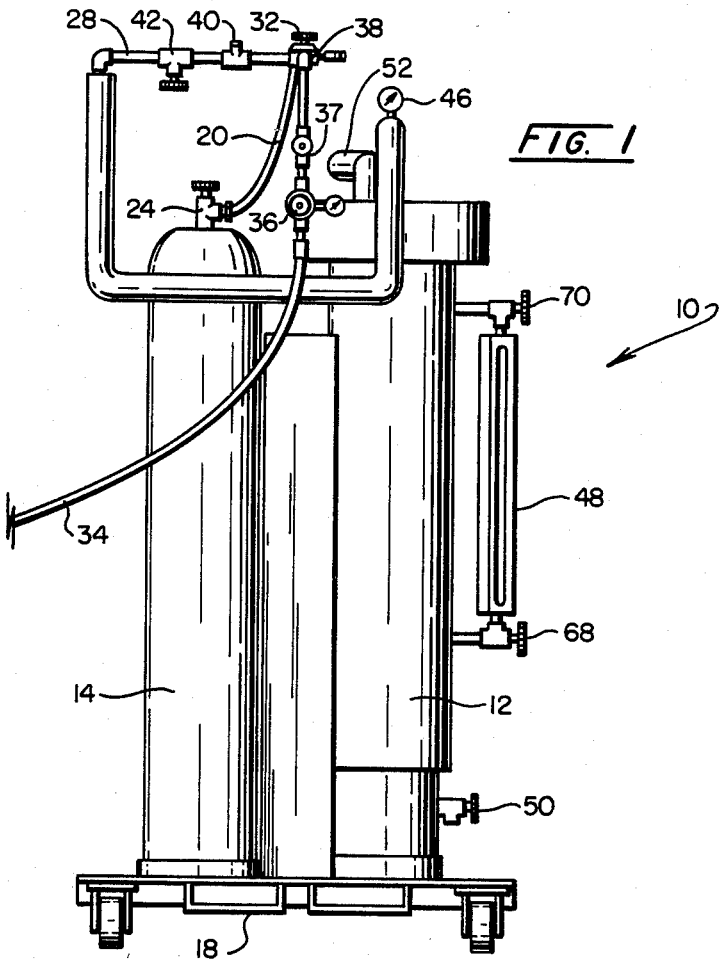
FIG. 1 is a side elevational view of a completely contained portable generator of the present invention.

The drawings will be described in greater detail in connection with the following description.

DETAILED DESCRIPTION OF THE INVENTION

While the generator may be permanently installed in a plant for use, the unique design of the generator permits it to be made portable. Such portability means that the generator can be used in locations and under circumstances where space for a permanent generator is unavailable or where only temporary need of a generator exists. In order to amplify the flexibility in designing a portable generator, the drawings depict a portable generator which has been constructed and has been operated to supply vaporous tertiary amine vapors in nitrogen or air for use in the vaporous spray process of Blegen cited above. The invention, accordingly, will be illustrated specifically by the portable amine generator depicted in the drawings, but such description is not to be construed to be a limitation on the present invention. Thus, the unique design of the vapor generator of the present invention can be suitably adapted to generate a vapor of virtually any liquid borne by gas which is inert or reactive under the conditions of use.

For present purposes, "vaporous state" or "vapors" generated by the vapor generator of the present invention include both the gaseous phase of the liquid as well as an atomizate of the liquid. Thus, the term is to be construed broadly. For example in cold box curing operations (eg. at 15 psia), triethyl amine (TEA) has a boiling point of 196° F., dimethyl ethyl amine (DMEA) has a boiling point of 100° F., and trimethyl amine (TMA) has a boiling point of 24° F. Thus, "vapors" of such amines include an inert carrier gas bearing TMA as a gas, or DMA or TEA as entrained atomizates. Such liquid atomizates also preferably saturate the carrier gas at the pressure and temperature of operation.

Figure 2:
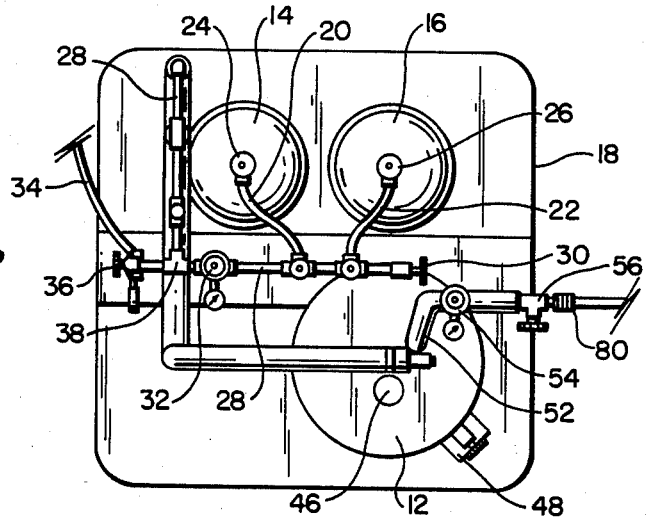
FIG. 2 is an overhead view of the portable generator assembly of FIG. 1.
Figure 3:
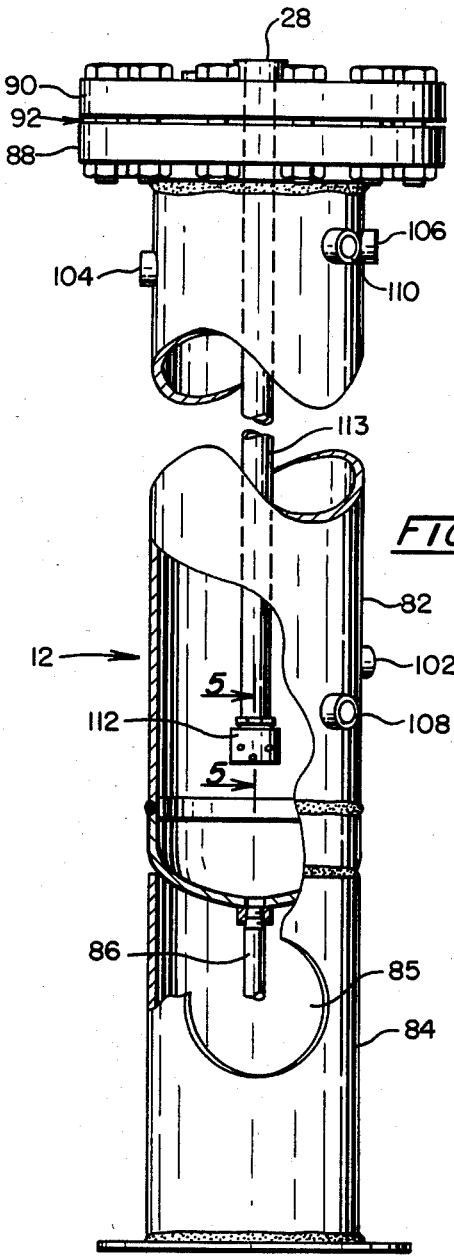
FIG. 3 is a side elevational view of the pressure vessel and gas line extending thereinto with cutaway sections for viewing details of the interior.
Figure 4:
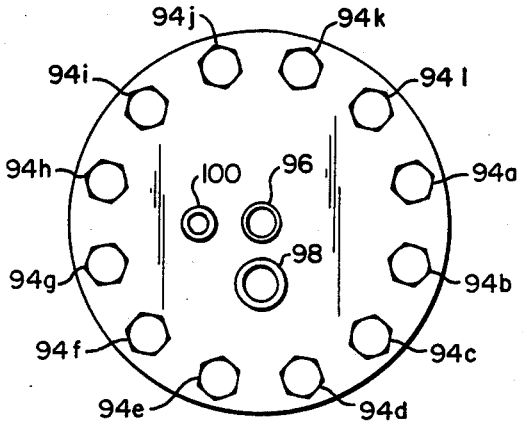
FIG. 4 is an overhead view of the pressurized vessel of FIG. 3.

Referring to FIGS. 1 and 2, the portable vapor amine generator is represented generally at 10. This assembly includes wheeled skid 18 upon which rests inert gas tanks 14 and 16 (see FIG. 2) and amine vessel assembly 12. The portable amine generator is designed to utilize nitrogen in tanks 14 and 16, though carbon dioxide, air, or any suitable carrier gas could be utilized. With reference to the process flow of the portable amine generator, not all fittings and valves will be apparent from FIGS. 1 and 2. On such occasions, reference is made to FIG. 7 which provides the detailed process flow diagram.

Nitrogen from tank 14 flows via line 20 through shut-off valve 24 into main gas line 28 as can nitrogen flow from tank 16 flow via line 22 past shut-off valve 26 into line 28. Provision for two tanks enables the portable amine generator to operate for longer periods of time, though it will be appreciated that the assembly may contain one or multiple tanks of inert gas. Nitrogen entering main gas line 28 from tanks 14 and 16 flow through check valves 25 and 27, respectively. Main gas line 28 is fitted with shut-off valve assembly 30 to which an additional gas line may be affixed, if desired. The flow of nitrogen through main gas line 28 then passes through first pressure regulator 32 which controls the pressure, $P_v$, within amine vessel 12. The portable vaporous amine generator additionally is provided with the capability of switching to plant air for use via tee 38 in main gas line 28. Air line 34 passes plant air through air pressure regulator 36, shut-off valve 37, thence into tee 38 for admission into main gas line 28. Thus, the portable vaporous amine generator has the flexibility of being entirely self-contained in its provision for carrier gas, or may utilize existing air, inert gas, or other carrier gas at the plant site, as is necessary, desirable, or convenient.

Continuing with specific reference to nitrogen as the carrier gas from tanks 14 and 16, the nitrogen flows past tee 38 through flow meter 40, shut-off check valve 42 and into amine vessel assembly 12. Main gas line 28 is provided with heating tape and insulation prior to its joining to vessel assembly 12 (heating tape shown in FIG. 7). The nitrogen or other carrier gas is heated in order to minimize thermal shock upon its entry into vessel assembly 12 which is heated.

Vaporous amine in the carrier gas is withdrawn from vessel assembly 12 via line 52 which contains second pressure regulator 54. Second pressure regulator 54 controls the delivery pressure, $P_d$, of the vaporous amine gas flow, for example, to a spray gun. The provision for first pressure regulator 32 and second pressure regulator 54 enable independent control of the pressure in vessel assembly 12 and delivery pressure of the product vaporous amine, thus ensuring constant amine concentration in vessel 12 as well as constant delivery pressure in line 52 of the product vaporous amine gas flow. The first pressure regulator preferably has a greater capacity and lower pressure drop thereacross than does the second pressure regulator. The remaining valving and other process flow equipment will be further detailed in connection with the description of FIG. 7.

Referring to the details of construction of vessel assembly 12 at FIGS. 3–6, vessel assembly 12 is composed of amine tank 82 which is mounted on base 84. Base 84 contains access hole 85 and an additional oppositely disposed access hole not shown in the drawings. Drain pipe 86 from amine tank 82 is connected to shut off valve 56 for draining the amine from the tank when required. The upper section of main tank 82 is composed of flanges 88 and 90 between which is disposed gasket 92. Flanges 88 and 90 are bolted together by bolts **94*a*–94*l*. Upper flange 90 contains inlet 96 to which is connected main gas line 28, fill inlet 98 which through valve 60 permits amine to be added to tank 82, and outlet port 100 for withdrawing product vaporous amine gas flow. Disposed downwardly from inlet port 96 is dip pipe 113**.

Amine tank 82 contains temperature control port 102 for temperature controller 74, temperature indicator port 104, and pressure relief port 106 for safety relief valve 66. Amine tank 82 additionally contains side arm assembly 48 which is composed of shut-off valves 68 and 70, between which is disposed side arm site glass 71 for determining the level of amine in tank 82. Side arm assembly 48 is connected into amine tank 82 through ports 108 and 110.

Figure 5:
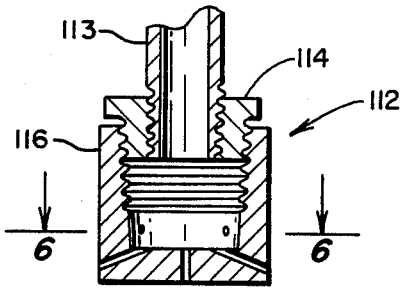
FIG. 5 is a section through the gas distributor means which terminates the gas line extending into the pressurized vessel taken along line 5—5.
Figure 6:
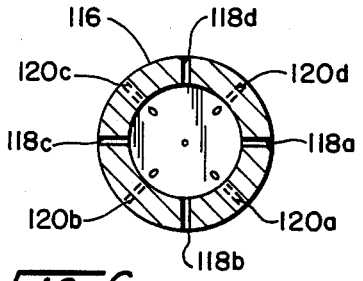
FIG. 6 is a section of the gas distributor of FIG. 5 taken along line 6—6.

Nitrogen or other carrier gas from main gas line 28 enters amine tank 82 through inlet port 96 and passes down dip pipe 113 to gas distributor assembly 112. Referring specifically to FIGS. 5 and 6, gas distributor assembly 112 comprises threaded bushing 114 (1 inch × ½ inch) and gas distributor cap 116 (2 inch diameter). Gas distributor cap 116 contains 13 holes each of which is 1/16 inch diameter. An upper row of holes 120*a*–120*d* are skewed upwardly. Lower row of four holes 118*a*–118*d* similarly are skewed upwardly, but are disposed between each pair of upward holes 120 (ie. 45° apart). The bottom of gas distributor cap 116 has four equally spaced holes which are skewed inwardly and one center hole. These bottom holes are not labeled for convenience in understanding FIG. 6. The 13 holes provide intimate contact between the nitrogen or other carrier gas and amine disposed in tank 82. The size and placement of the holes of gas distributor assembly 112 is based upon the article by W. J. Litz, "Design of Gas Distributors", CHEMICAL ENGINEERING, Nov. 13, 1972 (pp 162–166). Intimate contact between the carrier gas and the liquid amine is necessary in order to saturate the carrier gas with the proper concentration of amine depending upon the pressure and temperature, $T_v$, established within amine tank 82.

Figure 7:
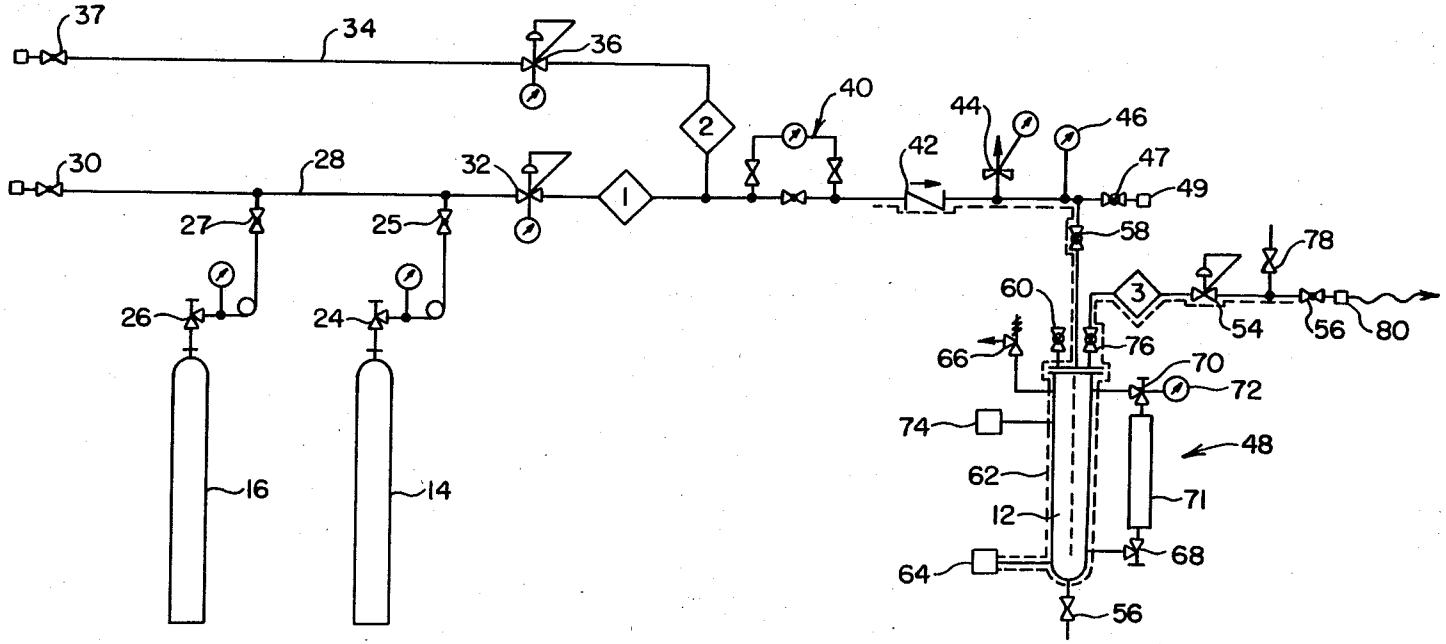
FIG. 7 is the process flow diagram of the portable generator assembly of FIG. 1.

Referring to FIG. 7, the process flow diagram of portable generator 10 is set forth. Much of the valving and other equipment has been described in connection with FIGS. 1 and 2, though some of the equipment is not visible due to insulation about the lines, e.g. insulation about vessel 82, etc. Commencing with the flow description at tee 38 where nitrogen gas flow and plant air flow merge, the carrier gas passes through flow meter assembly 40, check valve 42, and pressure relief valve 44. All of this section of main gas line 28 up to its connection to amine tank 82 at inlet port 96 is wrapped by heating tape and insulation as described above. The temperature at this point in main gas line 28 is displayed by dial thermometer 46. Main gas line 28 has provision via plug 49 and shut-off valve 47 to have an additional gas line connected thereto. The carrier gas flow then passes through valve 58 into amine tank 82. Amine tank 82 is fully insulated and has a lower heater for liquid amine which is controlled by temperature controller 64 which additionally controls heating tape 62. The upper headspace in amine tank 82 is heated by a second and larger heater which is controlled by temperature controller 74. It is important to ensure that the headspace, which contains the vaporous amine in the carrier gas, is maintained at the appropriate temperature, $T_v$, in order for the composition of the flow, i.e. concentration of amine, to be constant and at a desired level. As noted above, vessel 82 is fitted with safety relief valve 66 as well as side arm assembly 48. The vaporous amine gas flow is withdrawn from vessel 82 through outlet 100 via line 52 (FIG. 2) which contains shut-off valve 76. The flow then passes through second pressure regulator 54, described above, which is disposed in line 52. Outlet line 52 then contains sample port 78, shuf-off valve 56, and coupling 80 to which an outlet line may be affixed.

Figure 8:
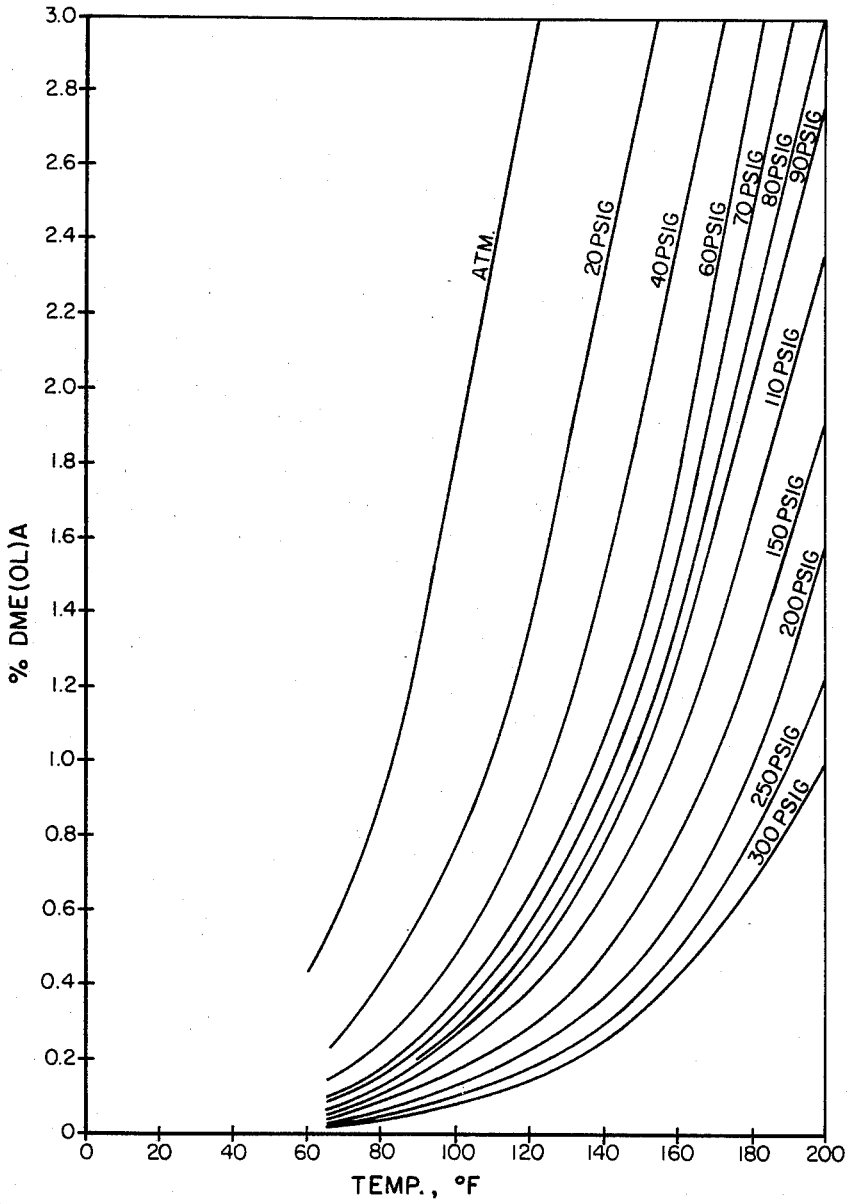
FIGS. 8–10 are compositional graphs of dimethyl ethanol amine, tetramethyl ethylene diamine, and triethyl amine, respectively, at various temperatures and pressures.
Figure 9:
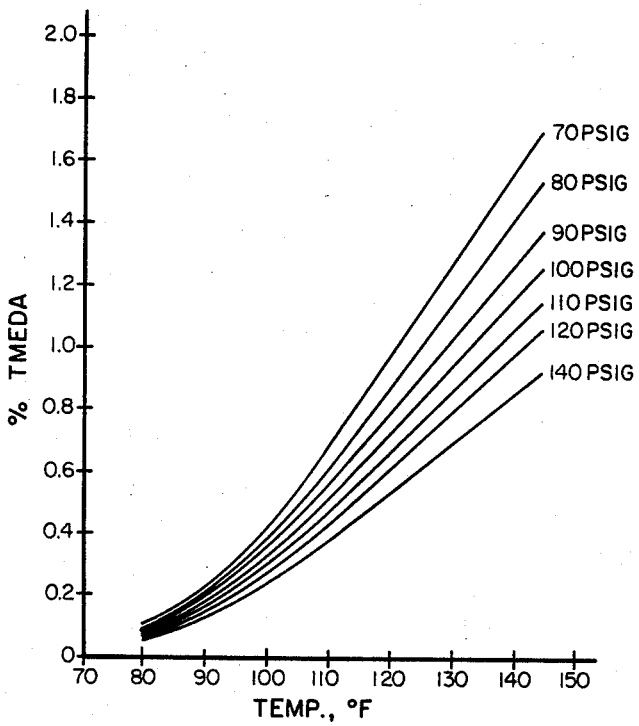
Figure 10:
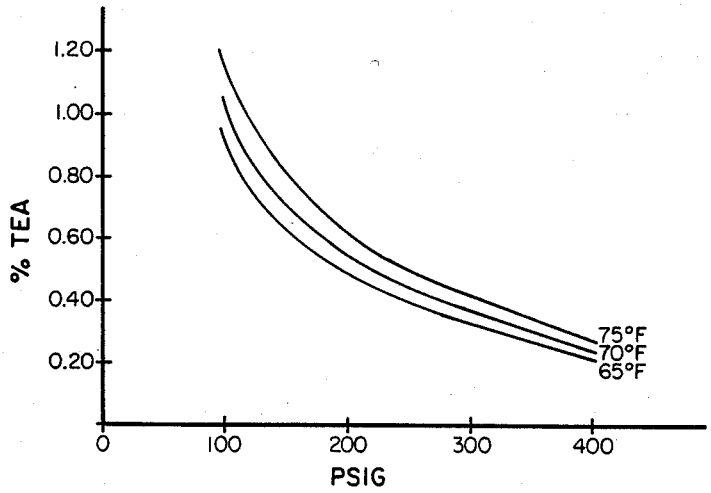

Because of the unique provision of pressure regulator means for independent control of pressure within amine tank 82 and delivery pressure of the vaporous gas flow therefrom, control over the concentration of vaporous amine is managed readily. FIGS. 8–10 provide vaporous amine concentration for dimethyl ethanol amine, tetramethyl ethylene diamine, and triethyl amine, respectively, which have been utilized in the portable generator of the present invention. The operator of the vapor generator need only utilize such charts for obtaining the desired amine concentration by judicious selection of temperature $T_v$, of amine tank 82 and pressure, $P_v$, within amine tank 82 controlled by first pressure regulator 32. Additionally, because the temperature and pressure can be so precisely maintained, the operator has the luxury of utilizing a variety of conditions, all of which provide the requisite amine concentration desired. For example, when tanks 14 and 16 contain nitrogen, carbon dioxide, air, or other carrier gas under high pressure, the operator may choose to operate the generator at a higher pressure and higher temperature. Conversely, when utilizing lower pressure plant air, the operator then may select lower temperatures in order to maintain the desired amine concentration. It will be appreciated, of course, that similar charts may be developed for other compounds which are desired to be utilized in the vapor generator of the present invention.

It will be appreciated that the foregoing description merely is illustrative of the precepts upon which the present invention is based. Many modifications may be made to the vapor generator of the present invention and still remain within the teachings herein as those skilled in the art will appreciate. All references cited herein are expressly incorporated herein by reference.

I claim:

1. Generator for generating a supply of a gas bearing vapors of a compound at a desired concentration, said supply being generated on demand at a desired constant delivery pressure, $P_d$, which comprises:

a gas inlet line for conveying pressurized gas at a pressure, $P_s$, from a source thereof through first pressure regulator means to a vessel;

said vessel retaining a reservoir of said compound in its liquid phase and headspace thereabove, said vessel being insulated and having heating means to maintain said liquid and said headspace at a desired temperature, $T_v$;

said gas inlet line extending into said vessel to a position within said reservoir of liquid and there being terminated with gas distributor means;

said vessel being provided with an overhead vapors outlet from said headspace for withdrawing said gas bearing vapors of said compounds generated in said vessel; and a gas outlet line connected from said vessel vapors outlet to second pressure regulator means, said first pressure regulator means independently controlling the pressure in said vessel, $P_v$, said second regulator means independently controlling the delivery pressure, $P_d$, of said gas bearing said vapors, and said desired concentration of vapors in said supply of outlet gas being determined by said vessel pressure, $P_v$, and said vessel temperature, $T_v$.

2. The generator of claim 1 wherein said gas inlet line is heated and insulated.

3. The generator of claim 1 wherein said gas outlet line is heated and insulated.

4. The generator of claim 1 wherein tanks containing said source of pressurized gas and said vessel are mounted on a base for making the resulting assembly portable.

5. A method for generating a supply of a gas bearing vapors of a compound at a desired concentration, said supply being generated on demand at a desired constant delivery pressure, $P_d$, which comprises:

conveying pressurized gas at a pressure, $P_s$, from a source thereof through first pressure regulating means to a vessel, said vessel retaining a reservoir of said compound as a liquid phase and having head space thereabove and being insulated;

heating said reservoir and said headspace with heating means to maintain said liquid in said headspace at a desired temperature, $T_v$;

contacting said gas with said reservoir through said gas line which extends into the vessel to a position within said reservoir of liquid, said contact being through gas distributor means which are disposed about the end of said gas line within said reservoir;

withdrawing said supply of said gas bearing said vapors from a vessel vapors outlet which is in communication with said head space; and passing said supply through a gas outlet line to second presure regulating means, said first regulator means independently controlling the pressure in said vessel and said second pressure regulator means independently controlling said delivery pressure, the desired concentration of vapors in said supply of outlet gas being determined by the vessel pressure and the vessel temperature.

6. The method of claim 5 wherein said liquid comprises a tertiary amine.

7. The method of claim 5 wherein said gas is air.

8. The method of claim 5 wherein said gas is an inert gas.

9. The method of claim 8 wherein said inert gas is nitrogen or carbon dioxide.

10. The method of claim 5 wherein said pressurized gas is conveyed to said vessel through a gas inlet line which is heated and insulated; and said gas outlet line is heated and insulated.

* * * * *